US011267260B2

(12) United States Patent
Sano et al.

(10) Patent No.: US 11,267,260 B2
(45) Date of Patent: Mar. 8, 2022

(54) CONVEYANCE MECHANISM AND LABEL PRINTER

(71) Applicant: Ishida Co., Ltd., Kyoto (JP)

(72) Inventors: Taro Sano, Ritto (JP); Koji Araki, Ritto (JP)

(73) Assignee: Ishida Co., Ltd., Kyoto (JP)

( * ) Notice: Subject to any disclaimer, the term of this patent is extended or adjusted under 35 U.S.C. 154(b) by 56 days.

(21) Appl. No.: 16/678,263

(22) Filed: Nov. 8, 2019

(65) Prior Publication Data

US 2020/0147980 A1 May 14, 2020

(30) Foreign Application Priority Data

Nov. 13, 2018 (JP) ..... JP2018-213245

(51) Int. Cl.
*B41J 11/00* (2006.01)
*B41J 3/407* (2006.01)

(52) U.S. Cl.
CPC ..... *B41J 11/007* (2013.01); *B41J 3/4075* (2013.01)

(58) Field of Classification Search
CPC ..... B41J 3/4075; B41J 11/007; B41J 29/38; B41J 15/04; B65C 9/02; B65C 9/18; B65C 9/42; B65C 9/08
See application file for complete search history.

(56) References Cited

U.S. PATENT DOCUMENTS

| | | | |
|---|---|---|---|
| 4,769,103 | A | 9/1988 | Koike et al. |
| 2004/0074582 | A1 | 4/2004 | Davis et al. |
| 2012/0193022 | A1* | 8/2012 | Yamasita ..... B65C 9/42 156/249 |

FOREIGN PATENT DOCUMENTS

| | | | |
|---|---|---|---|
| CA | 2 176 505 | C | 11/2002 |
| CN | 108139530 | A | 6/2018 |
| EP | 2481675 | A2 | 8/2012 |
| EP | 3150528 | A1 | 4/2017 |
| JP | 2009-078839 | A | 4/2009 |
| JP | 2013-248816 | A | 12/2013 |
| JP | 5962225 | B2 | 8/2016 |
| JP | 2017-128140 | A | 7/2017 |
| WO | 96/10489 | A1 | 4/1996 |

OTHER PUBLICATIONS

The extended European search report issued by the European Patent Office dated Apr. 17, 2020, which corresponds to European Patent Application No. 19208403.6-1017 and is related to U.S. Appl. No. 16/678,263.

* cited by examiner

*Primary Examiner* — Jannelle M Lebron

(74) *Attorney, Agent, or Firm* — Studebaker & Brackett PC

(57) ABSTRACT

A conveyance mechanism is configured to sandwich a label including the adhesive side, on which an adhesive has been provided, between a drive roller and a rotatably provided assist roller and to drive the drive roller in order to unwind the label from a label roll in which the label is wound. The assist roller includes a contact portion configured to come into contact with at least a part of the print side of the label. The contact portion is provided so as to avoid coming into contact with an adhesive oozing from at least one of edges of the label along a conveyance direction of the label.

9 Claims, 9 Drawing Sheets

CONVEYANCE MECHANISM AND LABEL PRINTER

TECHNICAL FIELD

An aspect of the present disclosure relates to a conveyance mechanism and a label printer.

BACKGROUND

A linerless label, one of labels, is wound in roll form with the adhesive side exposed, and hence, an adhesive may ooze from end faces of the wound label roll. The linerless label is sandwiched between a drive roller configured to rotate in a state of contacting the adhesive side of the linerless label and an assist roller configured to rotate in a state of contacting the print side of the linerless label, so as to unwind from the label roll. At this time, an adhesive oozing from the linerless label sticks to the assist roller because the surface of the drive roller is generally formed of material having release characteristics.

The adhesive sticking to the assist roller is repeatedly pressed by the drive roller, thereby moving to an end portion of the assist roller and setting up around its rotation shaft. The set-up adhesive prevents the assist roller from rotating freely. This disables proper feed control of the linerless label. For this reason, an adhesive sticking to the assist roller needs to be removed in using a label roll from which an adhesive oozes.

In order to address this problem, Japanese Unexamined Patent Publication No. 2009-78839 discloses an invention including an assist roller 60 including depressed portions 65 each formed on an outer periphery of a roller portion 62, which is parallel to a rotation shaft 61, in between a small diameter portion 63 and a guard portion 64 located outer than the small diameter portion 63, as illustrated in FIG. 9. In this invention, an adhesive is collected in the depressed portions 65 so as not to move to the rotation shaft 61 over the guard portions 64.

Unfortunately, the invention disclosed in Japanese Unexamined Patent Publication No. 2009-78839 does not treat linerless labels but aims to solve a problem in that an adhesive sticking to the liner (release liner) from which a label has been released sticks to an assist roller before the assist roller winds the liner. Accordingly, the invention disclosed in Japanese Unexamined Patent Publication No. 2009-78839 is common to an aspect of the present disclosure in respect of aiming to solve a problem associated with an adhesive sticking to a roller, but has a configuration in which an adhesive is collected in the depressed portions 65 of the assist roller 60 and the collected adhesive is removed later, and therefore does not satisfy the requirement of preventing an adhesive from sticking to the assist roller 60.

It is a subject of an aspect of the present disclosure to provide a conveyance mechanism capable of feeding a linerless label while preventing an adhesive from sticking to a drive roller and an assist roller when the linerless label is sandwiched by the rollers in order to be fed, and a label printer with the conveyance mechanism mounted thereon.

SUMMARY

A conveyance mechanism according to an aspect of the present disclosure is configured to sandwich a label including an adhesive side, on which an adhesive has been provided, between a drive roller and a rotatably provided assist roller and to drive the drive roller in order to unwind the label from a label roll on which the label is wound, the assist roller includes a contact portion configured to come into contact with at least a part of the print side of the label, and the contact portion is provided so as to avoid coming into contact with an adhesive oozing from at least one of edges of the label along a conveyance direction of the label.

In this configuration, the assist roller is provided with the contact portion configured to avoid the adhesive oozing from an edge of the label and sandwich the label with the drive roller. Thus, the adhesive oozing from the edge is sent downstream while remaining oozing from the edge of the label, without sticking to the assist roller.

In the conveyance mechanism according to an aspect of the present disclosure, the outer surface of the drive roller may have release characteristics (a tendency not to adhere to the outer surface) with respect to the label that are superior to release characteristics of the outer surface of the assist roller with respect to the label. This configuration can reduce the occurrence of the adhesive that oozes from at least one of the edges of the label along the conveyance direction of the label sticking to the drive roller.

In the conveyance mechanism according to an aspect of the present disclosure, the drive roller may come into contact with the label across a full width in a direction orthogonal to the conveyance direction of the label. With this configuration, the drive roller comes into contact with the adhesive side of the linerless label across the full width to uniformly pull the label. Hence, the fed label does not snake.

In the conveyance mechanism according to an aspect of the present disclosure, the assist roller includes the contact portion and a small diameter portion, an outer diameter of which is smaller than an outer diameter of the contact portion. The small diameter portion may be provided in the lengthwise direction of a rotation shaft of the assist roller in a region into which an adhesive oozes from at least one of the edges of the label. This can prevent the assist roller from coming into contact with an adhesive oozing from at least one of the edges of the label at the small diameter portion, and can consequently reduce the occurrence of the above-described adhesive sticking to the assist roller.

In the conveyance mechanism according to an aspect of the present disclosure, the small diameter portion may be provided in the lengthwise direction in a region having a predetermined width centered on one of the edges. This configuration can allow for properly setting the region into which an adhesive oozes from at least one of the edges, depending on a kind (property) of label.

In the conveyance mechanism according to an aspect of the present disclosure, a plurality of the small diameter portions may be provided along the lengthwise direction. This configuration can save time for replacing labels having different widths together with the corresponding assist roller and for changing the position of the assist roller, because the small diameter portions are provided such that their positions in the width direction correspond to a plurality of kinds of label having a different width.

In the conveyance mechanism according to an aspect of the present disclosure, the label may be a label with liner the adhesive side of which is stuck on a liner (release liner). That is, the conveyance mechanism according to an aspect of the present disclosure is configured to draw out the label with liner from the label roll by means of the drive roller that rotates in contact with the adhesive side of the label with liner and the assist roller that rotates and presses the label with liner against the drive roller, the assist roller having a contact portion that avoids the adhesive oozing from the edges of the label with liner and presses the label with liner against the drive roller. The conveyance mechanism with this configuration can reduce the occurrence of an adhesive oozing from at least one of the edges of the label with liner sticking to the assist roller.

In the conveyance mechanism according to an aspect of the present disclosure, the label may be a linerless label the adhesive side of which is exposed. That is, the conveyance mechanism according to an aspect of the present disclosure is configured to draw out the linerless label from the label roll by means of the drive roller that rotates in contact with the adhesive side of the linerless label and the assist roller that rotates and presses the linerless label against the drive roller, the assist roller having a contact portion that avoids the adhesive oozing from the edges of the linerless label and presses the linerless label against the drive roller. The conveyance mechanism with this configuration can reduce the occurrence of the adhesive that oozes from at least one of the edges of the linerless label sticking to the assist roller.

A label printer according to an aspect of the present disclosure includes a loading unit into which the label roll is to be loaded, the above-described conveyance mechanism configured to unwind the label with liner from the loading unit, a print unit configured to perform printing on the label with liner fed from the conveyance mechanism, and an issuing unit disposed downstream of the print unit in the conveyance direction and configured to issue the printed label with liner.

In this configuration, the label with liner unwound from the label roll is conveyed to the print unit while holding the adhesive oozing from the edge, in order to be printed, and further conveyed downstream to the issuing unit to be cut to a predetermined length and issued as a label for a commodity.

A label printer according to an aspect of the present disclosure includes a loading unit into which the label roll is to be loaded, the above-described conveyance mechanism configured to unwind the linerless label from the loading unit, a print unit configured to perform printing on the linerless label fed from the conveyance mechanism, and an issuing unit disposed downstream of the print unit in the conveyance direction and configured to issue the printed linerless label.

With this configuration, the linerless label unwound from the label roll is conveyed to the print unit while holding the adhesive oozing from the edge, in order to be printed, and further conveyed downstream to the issuing unit to be cut to a predetermined length and issued as a label for a commodity.

In the label printer according to an aspect of the present disclosure, a non-stick coating may be applied to areas with which the adhesive side of the linerless label comes into contact in the conveyance path of the linerless label. The oozing adhesive sticks to the edge of the linerless label fed by the above-described conveyance mechanism. This adhesive, however, does not stick to the label printer until the linerless label is stuck on a commodity as a label for the commodity. This configuration can reduce conventionally required work of removing an adhesive.

DETAILED DESCRIPTION

Figure 1:
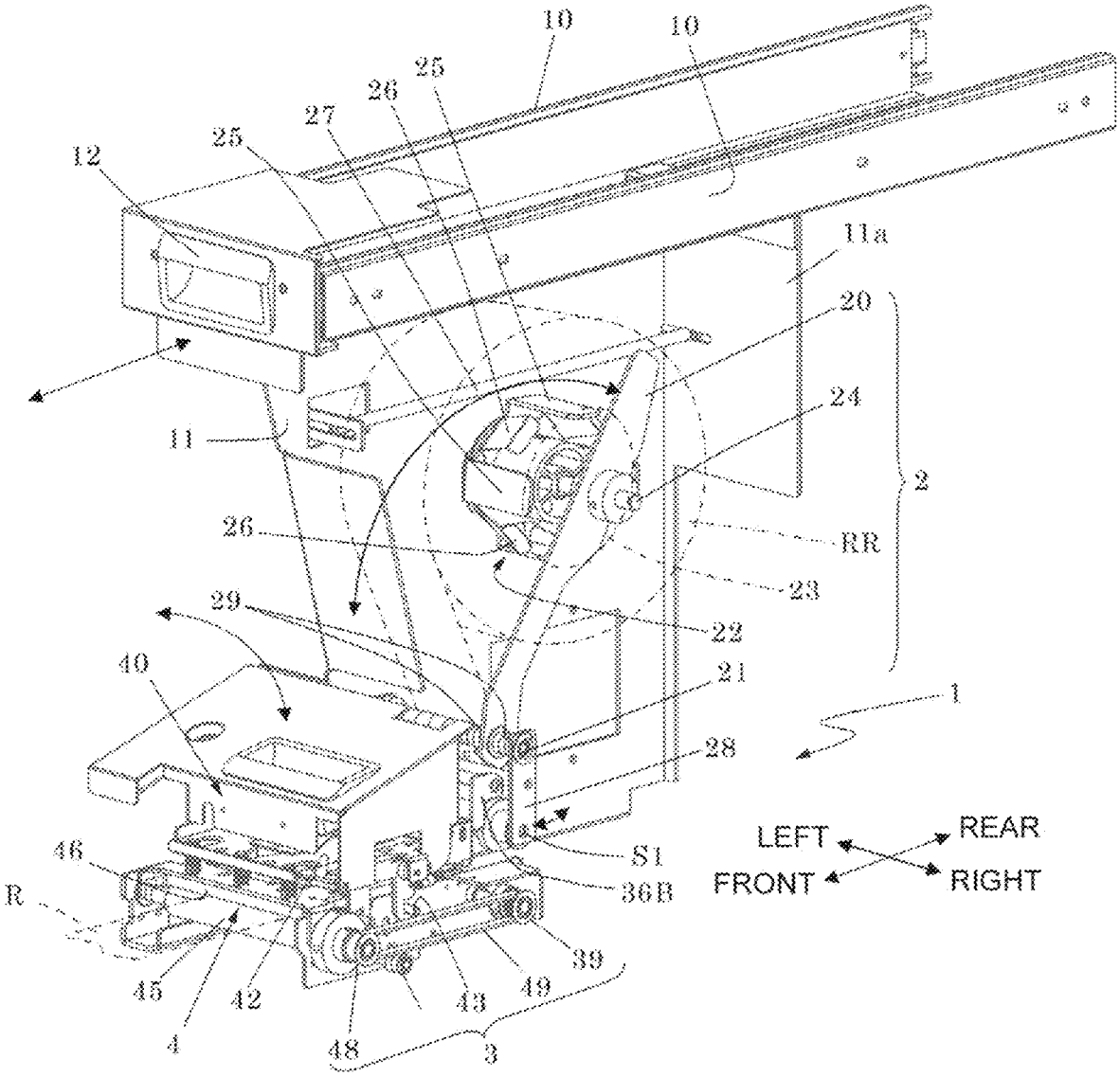
FIG. 1 is a perspective view of principle components of one embodiment of a label printer with a conveyance mechanism according to an aspect of the present disclosure mounted thereon.

The following will describe one embodiment of a conveyance mechanism according to an aspect of the present disclosure and one embodiment of a label printer with the conveyance mechanism mounted thereon, with reference to the accompanying drawings. It should be noted that the embodiments described herein are not intended to limit the technical scope of an aspect of the present disclosure.

In FIG. 1 to FIG. 5, a label printer 1 includes a loading unit 2 for a label roll RR, a conveyance mechanism 3 configured to unwind a linerless label R from the label roll RR in the loading unit 2, a print unit 4 configured to print a predetermined item on the linerless label R unwound by the conveyance mechanism 3, and an issuing unit 5 (see FIG. 5) configured to issue a printed linerless label R.

The label printer 1 is housed in a housing (not illustrated). The label printer 1 can be pulled forward when a cutting mechanism 50 (see FIG. 5) disposed downstream of the print unit 4 is retracted to a side. For this reason, a support frame 11 supporting the label printer 1 is attached to right and left top rails 10 fixed in the housing (not illustrated), in a manner slidable in the front-and-back direction indicated by an arrow.

A pull 12 is attached to a top front face of the support frame 11. When the pull 12 is pulled forward, the entire label printer 1 is pulled forward out of the housing through the support frame 11. It should be noted that the front-and-back direction here is a direction extending along the top rails 10 as illustrated in FIG. 1. A direction orthogonal to the front-and-back direction is referred to as "left-and-right direction".

The label printer 1 pulled out of the housing (not illustrated) is exposed up to a back board 11*a* in the back of the loading unit 2. With this configuration, in the label printer 1, the label roll RR can be loaded from a side (left-and-right direction) of the loading unit 2 exposed.

In order to load the label roll RR, a guide plate 20 disposed on the right side is rotated forward around a rotation shaft 21 disposed below, the right side of a core holder 22 is opened, and thereafter a core 23 of the label roll RR is inserted into the core holder 22. Thus, the label roll RR can be loaded into the loading unit 2. When the raised guide plate 20 is rotated backward around the rotation shaft 21 so as to return to its original position, an inverted u-shaped notch (not illustrated) formed in the guide plate 20 engages with a shaft 24 supporting the core holder 22. Thus, an end face of the label roll RR on the open side is restricted by the guide plate 20.

The core holder 22 includes four support plates 25 disposed around the shaft 24 so as to face one another, and four leaf springs 26 provided in between the support plates 25 and pushing the core 23 outward. On the left side of the loaded label roll RR, a horizontal rod 27 for restricting the left of the label roll RR is fixed in such a manner that its attachment position can be adjusted. Moving the horizontal rod 27 and the guide plate 20 in the left-and-right direction and fixing them can restrict both roll end faces of the label roll RR, thereby positioning the label roll RR in place. This position can be changed by removing a right plate 28 fixing the rotation shaft 21 of the guide plate 20 to increase or decrease the number of washers and collars 29, a plurality of which are inserted into the rotation shaft 21. This allows the attachment position of the guide plate 20 to be moved in the left-and-right direction (axial direction).

Figure 5:
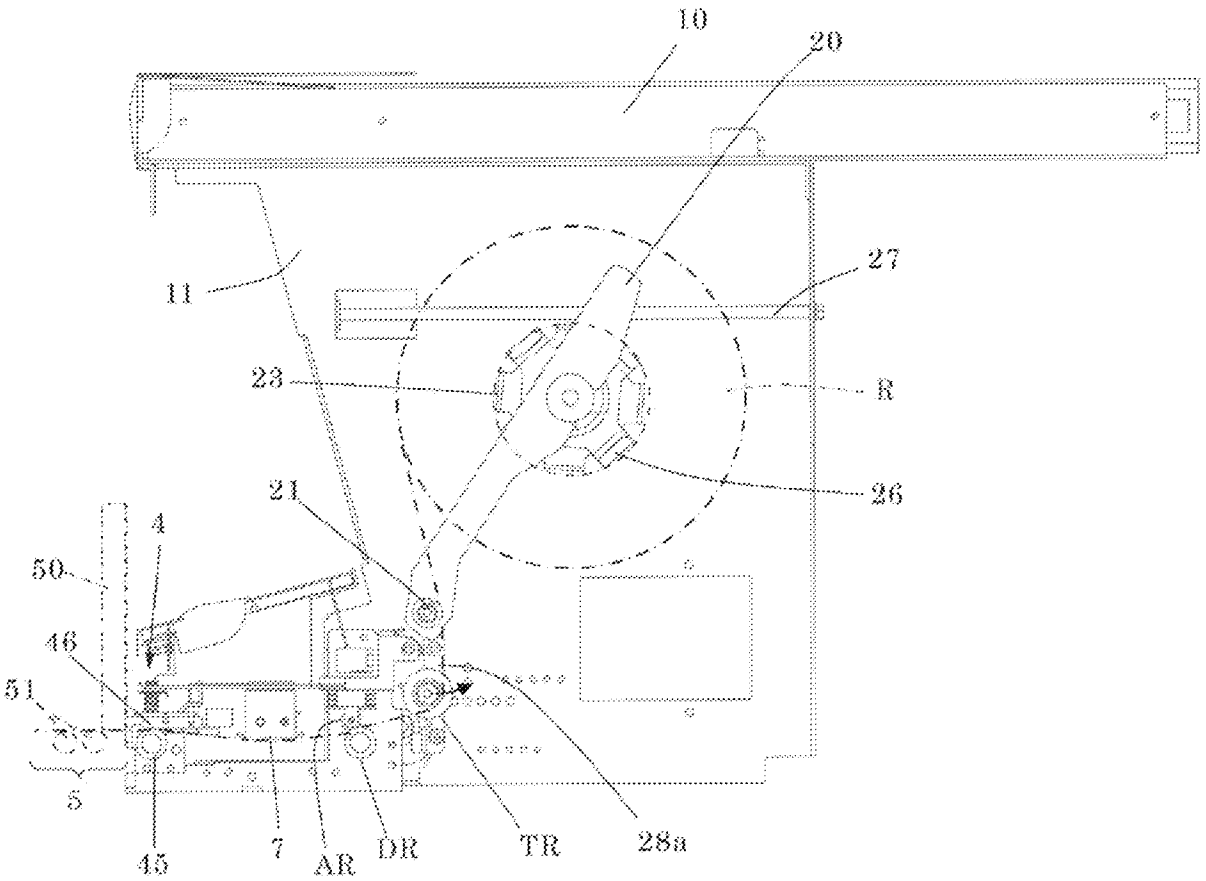
FIG. 5 is an explanatory drawing of a conveyance path of the linerless label in the label printer in FIG. 1.

The label roll RR is wound in roll form with the adhesive side of the linerless label R on the inside and the print side on the outside. The linerless label R unwound from the label roll RR is fed into the conveyance mechanism 3 with the print side contacting the turn roller TR and the adhesive side facing down, as illustrated in FIG. 5.

Figure 3:
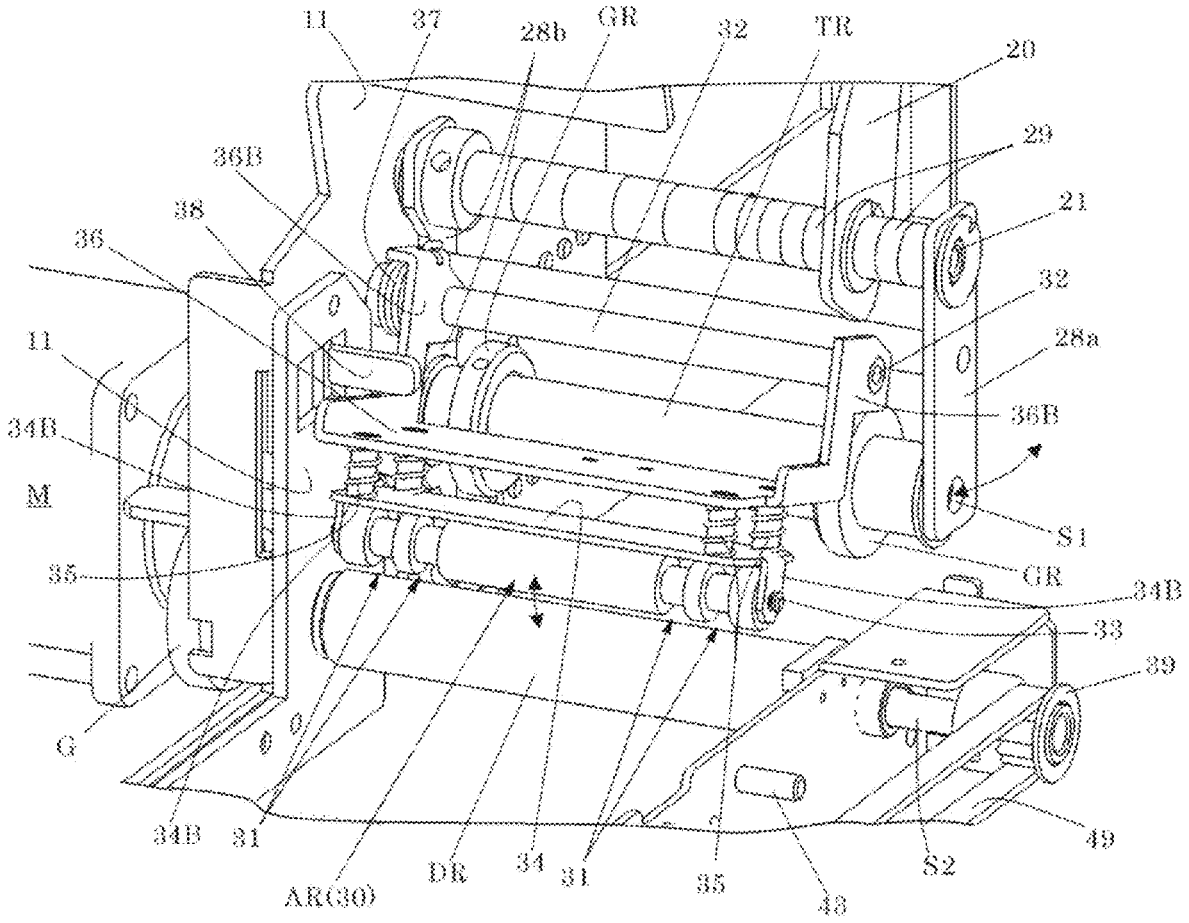
FIG. 3 is an enlarged perspective view of principle components of the conveyance mechanism in FIG. 2.

As illustrated in FIG. 3, the turn roller TR is disposed below the rotation shaft 21 supporting the guide plate 20, and attached in between right and left plates 28*a* and 28*b* configured to swing in the front-and-back direction from the rotation shaft 21 by a predetermined rotation angle. Specifically, a support shaft S1 rotatably supporting the turn roller TR is attached in between the right and left plates 28*a* and 28*b*, which are configured to rotate in the front-and-back direction around the rotation shaft 21 above the turn roller TR by a predetermined rotation angle.

A coil spring (not illustrated) is attached to the plate 28*b* on the left when viewed from the front. This coil spring allows the relevant plate 28*b* to rotate backward. The coil spring moves the turn roller TR backward when the linerless label R gets slack. This movement removes the slack from the linerless label R that was fed back. A guide ring GR that can change an attachment position in the axial direction (left-and-right direction) is attached on both sides of the turn roller TR.

Figure 2:
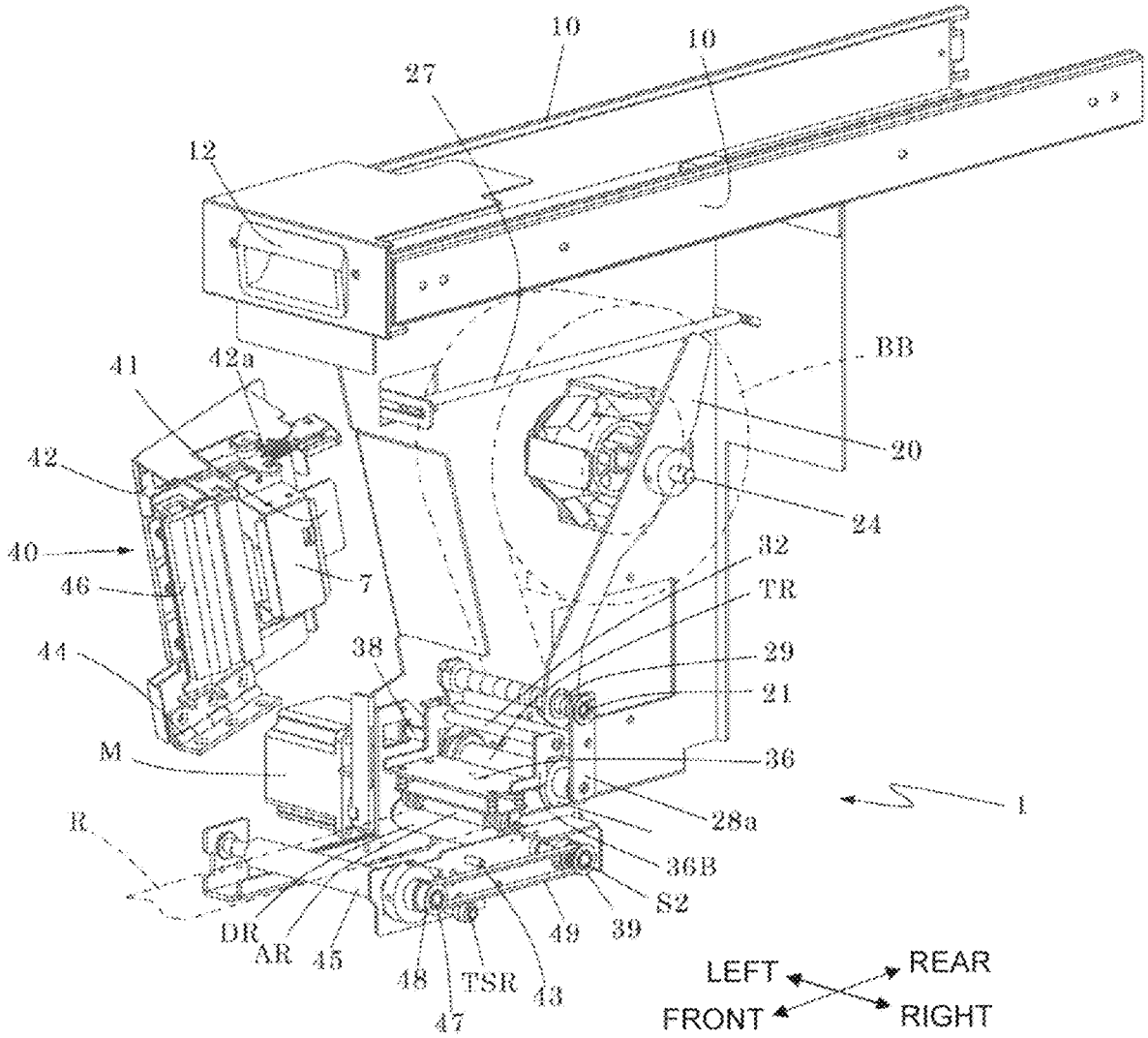
FIG. 2 is a perspective view of the principle components in a state in which the print unit in FIG. 1 is popped up to expose the conveyance mechanism.

The conveyance mechanism 3 includes a drive roller DR configured to rotate in a state of contacting the adhesive side of the linerless label R, and an assist roller AR configured to rotate while pressing the linerless label R against the drive roller DR, as illustrated in FIG. 2 and FIG. 3. In the conveyance mechanism 3, the drive roller DR rotates in a state in which the drive roller DR and the assist roller AR sandwich the linerless label R, whereby the linerless label R is forcibly unwound from the label roll RR.

It should be noted that FIG. 1 illustrates a state in which a print head unit 40 is closed. FIG. 2 illustrates a state in which the print head unit 40 is opened and the assist roller AR presses the linerless label R against the drive roller DR. FIG. 3 illustrates a state in which the assist roller AR is separated from the drive roller DR by the print head unit 40 being opened. This switching will be described later.

Figure 4:
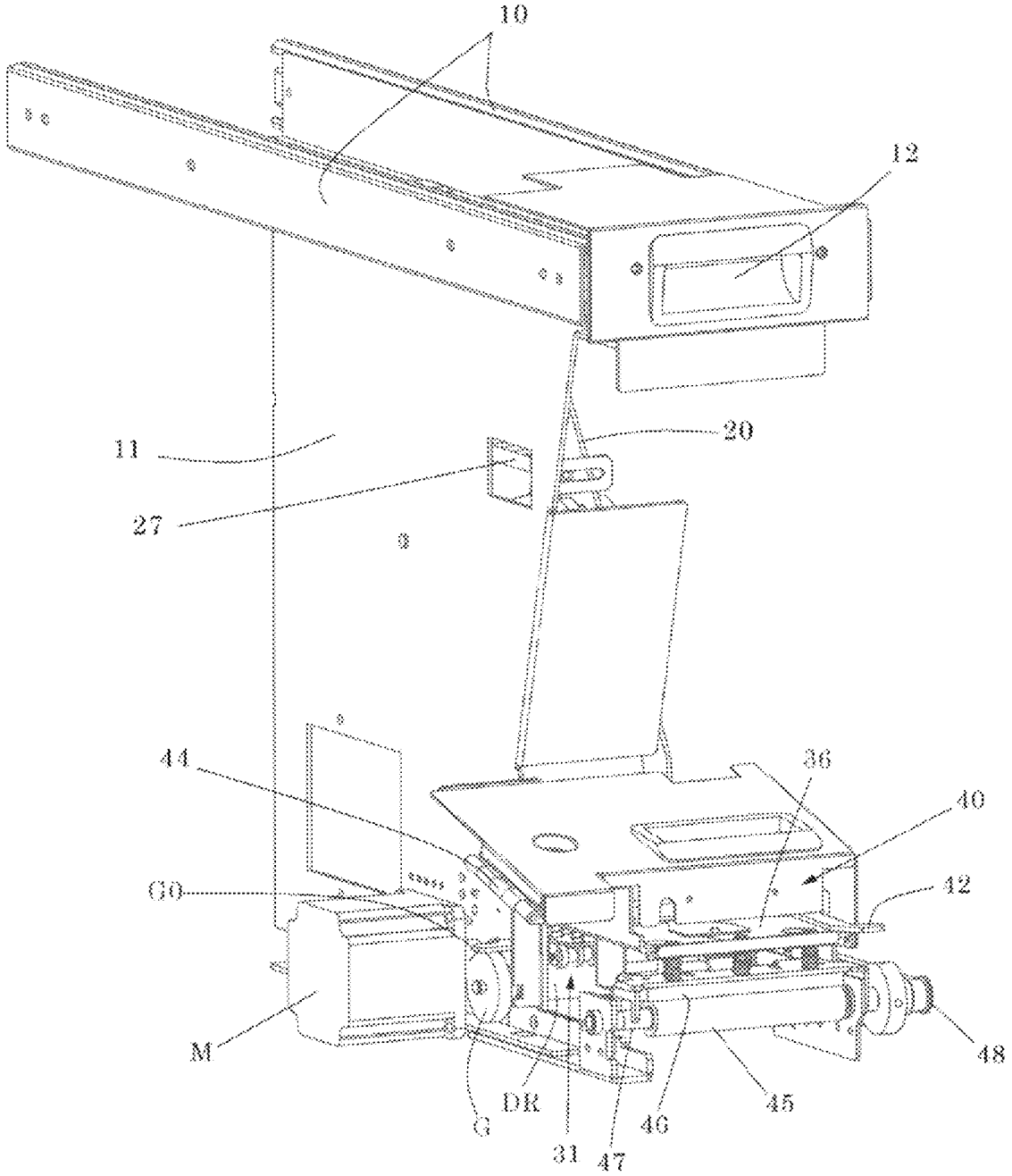
FIG. 4 is a perspective view of the principle components of the label printer in FIG. 1 as seen from the left when viewed from the front.

The drive roller DR is formed of material excellent in releasing the linerless label R, such as silicone rubber. Instead of or in addition to being formed of material having excellent release characteristics, the drive roller DR may have excellent release characteristics by including an outer surface (surface coming into contact with the linerless label R) with small projections and depressions formed thereon so as to decrease an area coming into contact with the linerless label R. The outer surface of the drive roller DR has release characteristics with respect to the linerless label R that are superior to the release characteristics of the outer surface of the assist roller AR. The drive roller DR includes a drive shaft S2 configured to engage with a rotation shaft of a motor M illustrated in FIG. 2 and FIG. 3 so as to rotate. Hence, a gear G illustrated in FIG. 3 and FIG. 4 is attached to a left end portion of the drive shaft S2 of the drive roller DR. The gear G is configured to engage with a gear G0 attached to the rotation shaft of the motor M so as to rotate.

The motor M is fixed to the housing (not illustrated). The drive roller DR is attached to the support frame 11 of the label printer 1. The gear G of the drive shaft S2 of the drive roller DR is separated from the gear G0 of the rotation shaft of the motor M when the label printer 1 is pulled forward. The gear G of the drive roller DR engages with the gear G0 of the motor M when the label printer 1, which was pulled forward, is pushed back.

Figure 6:
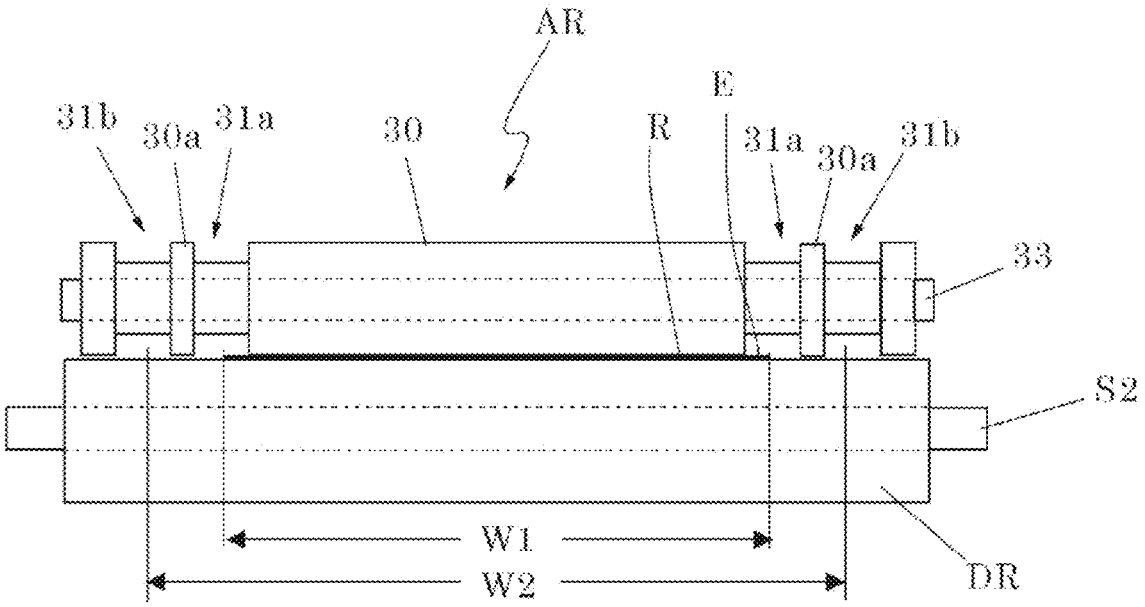
FIG. 6 is an enlarged front view of an assist roller according to one embodiment.

The assist roller AR is a roller made of synthetic resin. The assist roller AR is provided with a columnar contact portion 30 configured to press the linerless label R against the drive roller DR, and grooves 31 positioned on both sides of the contact portion 30 and configured to discharge an adhesive oozing from edges of the linerless label R, as illustrated in FIG. 3 and FIG. 6. The groove 31 discharging an adhesive oozing from edges of the linerless label R is configured as a small diameter portion, the outer diameter of which is smaller than the outer diameter of the contact portion 30. That is, the outer periphery of the groove 31 is formed to be lower than the outer periphery of the contact portion 30, when viewed in a direction of a rotation shaft of the assist roller AR. It should be noted that the assist roller AR may be a roller made of rubber instead of a roller made of synthetic resin. Also in this case, the outer surface of the assist roller AR has release characteristics with respect to the linerless label R that are inferior to the release characteristics of the outer surface of the drive roller DR formed of silicone rubber or any other material.

The right and left grooves 31 and 31 are provided in the assist roller AR so as to correspond to the width W of the linerless label R. Specifically, right and left inner grooves 31*a* and 31*a* illustrated in FIG. 6 are provided at positions that correspond to the edges E of the linerless label R the width W1 of which is 44 mm, for example. Right and left outer grooves 31*b* and 31*b* are provided at positions that correspond to the edges E of the linerless label R the width W2 of which is 60 mm, for example. Accordingly, when the linerless label R the width W1 of which is 44 mm is loaded, the right and left inner grooves 31*a* and 31*a* overlap the right and left edges E of the linerless label R. When the linerless label R the width W2 of which is 60 mm is loaded, the right and left outer grooves 31*b* and 31*b* overlap the right and left edges E of the linerless label R.

The size of the right and left grooves 31 and 31 in the width direction is, for example, 2 to 3 mm (predetermined width) with the right and left edges E of the linerless label R being the center. However, the sizes of the right and left grooves 31 and 31 in the width direction is not limited to this width, and can be changed as appropriate depending on properties (the width of the oozing adhesive and the like) of the linerless label R.

In the present embodiment, the columnar contact portion 30 at the center and large-diameter ring portions 30*a* on both sides of the contact portion 30 serve as contact portions configured to press the linerless label R against the drive roller DR, when the linerless label R the width W2 of which is 60 mm is loaded. With this configuration, an adhesive oozing from the edges E of the linerless label R is sent to the print unit 4 without sticking to the assist roller AR.

Figure 7:
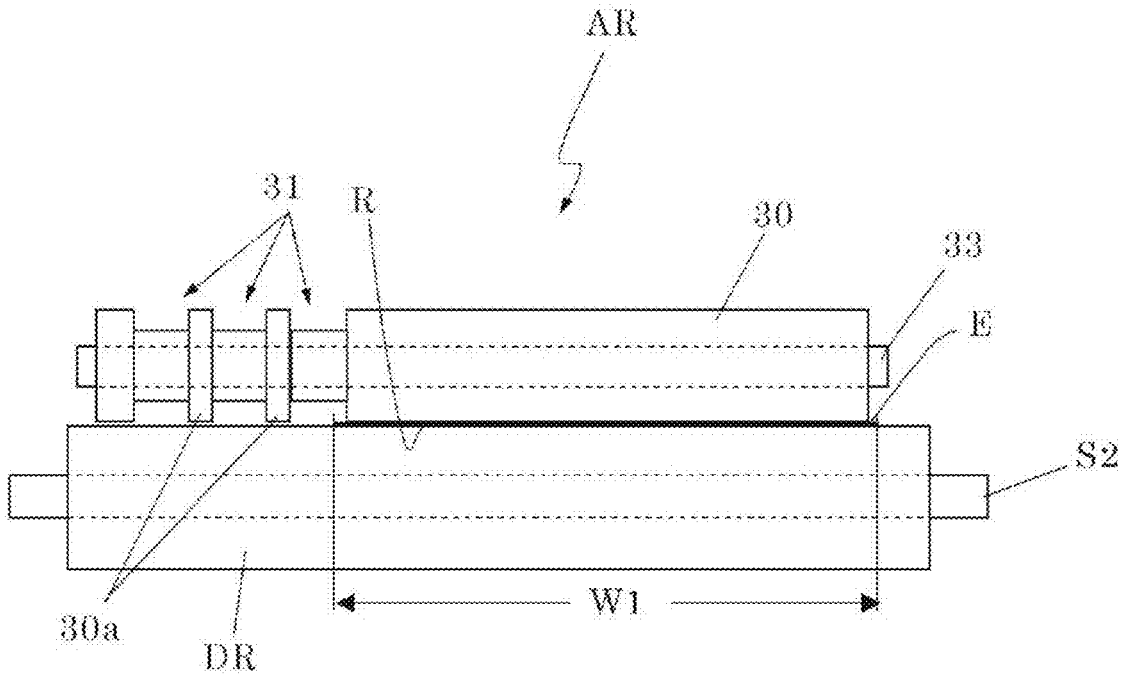
FIG. 7 is an enlarged front view of an assist roller according to a modification.

An example of the assist roller AR illustrated in FIG. 6 shows a pattern in which the center of the linerless label R is positioned at the center of the assist roller AR. In contrast, when the linerless label R is positioned such that an end of the linerless label R aligns with one of the end portions (for example, the right end) of the assist roller AR, the assist roller AR may not include the rightmost groove when viewed from the front but include a plurality of the grooves 31 on the left, as illustrated in FIG. 7. Moreover, the assist roller AR may include one groove 31 at the right end and the grooves 31 on the left side. It should be noted that if three grooves 31 are provided as illustrated in FIG. 7, three kinds of linerless label R having different widths can be used. In these embodiments, the large-diameter ring portions 30*a* provided to a side of the grooves 31 and the columnar contact portion 30 at the center serve as the contact portions configured to press the linerless label R against the drive roller DR. In this case, an adhesive oozing to either side of the linerless label R can be sent without sticking to the assist roller.

Referring back to FIG. 2 and FIG. 3, the assist roller AR is configured to swing upward and downward from the support shaft 32 disposed above the turn roller TR. That is, both end portions of the support shaft 33 rotatably supporting the assist roller AR are each fixed to downward-facing brackets 34B formed on both end portions of a base plate 34. Four coil springs 35, into which collars have been inserted, are attached to the top face of the base plate 34 at the four corners. The collars in the coil springs 35 are fitted in holes provided in a movable plate 36 above at the four corners, so as to vertically move.

The movable plate 36 is swingably attached to the support shaft 32 through right and left L-shaped brackets 36B. Thus, when the movable plate 36 is pressed downward, the assist roller AR rotates around the support shaft 32 downward so as to press the drive roller DR. At this time, the coil springs 35, into which the collars have been inserted, are compressed and accordingly the collars spring from the holes in the movable plate 36 at the four corners, and repulsive force of the compressed coil springs 35 causes the assist roller AR to press the drive roller DR.

The support shaft 32 rotatably supporting the movable plate 36 is supported by the left support frame 11 in a cantilevered manner. A torsion spring 37 is attached in between the support frame 11 and the left L-shaped bracket 36B. Repulsive force of the torsion spring 37 is exerted in a direction in which the movable plate 36 goes away from the drive roller DR, that is, upward. When the print head unit 40 illustrated in FIG. 2 is locked in a horizontal state as illustrated in FIG. 1, a push plate 41 protruding backward from the back end of the print head unit 40 pushes the movable plate 36 down, thereby pressing the assist roller AR against the drive roller DR with a predetermined pressure.

It should be noted that the right end of the print head unit 40 is provided with a lock mechanism configured to hold the print head unit 40 in the horizontal state. This lock mechanism includes an L-shaped lever 42 provided at the right end and a pin 43 configured to engage with a notch 42*a* provided in a low end portion of the lever 42. Pulling up the lever 42 disengages the lever 42 from the pin 43 of the notch 42*a*, whereby the print head unit 40 rotates about a hinge 44 illustrated in FIG. 2 so as to pop up to a side. As the print head unit 40 pops up to a side, the assist roller AR is separated from the drive roller DR. Rotation of the movable plate 36 is stopped by a stopper 38 of the support frame 11 on the left when the assist roller AR is separated from the drive roller DR by a predetermined distance.

The print unit 4, on the other hand, has a publicly-known configuration. The print unit 4 includes a platen roller 45 configured to feed the linerless label R and a print head 46 configured to press the linerless label R against the platen roller 45 so as to perform printing, as with conventional print units. The print unit 4 is attached to the housing (not illustrated) through the hinge 44 illustrated in FIG. 2. The label printer 1 in the present embodiment can be pulled forward, when the print unit 4 is popped up and rotated to a side about an axis of the hinge 44 so that the front of the label printer 1 is opened.

A timing pulley 48 is attached to the right end of a drive shaft 47 configured to rotate the platen roller 45. A timing pulley 39 is attached to the right end of the drive shaft S2 of the drive roller DR, as well. A timing belt 49 is looped on the timing pulleys 39 and 48, and thus rotation of the motor M is transferred to the platen roller 45 through the drive roller DR. Consequently, the drive roller DR and the platen roller 45 rotate in a synchronized manner. It should be noted that a tension roller TSR applying tension to the timing belt 49 is disposed below the timing belt 49 in FIG. 1 and FIG. 2.

FIG. 5 illustrates the conveyance path of the linerless label R unwound from the label roll RR in a dot-and-dash line. In this figure, a sensor unit 7 configured to detect whether the linerless label R is preset is provided in between the drive roller DR and the platen roller 45, and the issuing unit 5 is provided in front of the print unit 4. The issuing unit 5 has a publicly-known configuration. Specifically, the issuing unit 5 includes a label guide unit (not illustrated) configured to guide the printed linerless label R to the cutting mechanism 50 in the front, the cutting mechanism 50 configured to cut the linerless label R to a predetermined length, a label holder configured to hold the back end of the linerless label R at the vicinity of a boundary to be cut at the time of cutting the linerless label R, and standby rollers 51 configured to hold a cut label for a commodity.

The cutting mechanism 50 also has a publicly-known configuration. The cutting mechanism 50 is disposed so as to rotate in a horizontal plane around a vertical axis attached to the housing (not illustrated). Hence, in order to pull forward the label printer 1, the cutting mechanism 50 is retracted to a side and then the print head unit 40 is popped up to a side.

When the loading unit 2 of the label printer 1 is slid out of the housing, the label roll RR can be loaded and replaced. That is, when the loading unit 2 of the label printer 1 is slid out of the housing, the print head unit 40 pops up as illustrated in FIG. 2 and the assist roller AR gets away from the drive roller DR as well. Here, the linerless label R unwound from the label roll RR is fed under the turn roller TR, and threaded in between the assist roller AR and the drive roller DR from the opened right side. The leading edge of the linerless label R is then placed on the exposed platen roller 45 and the print head unit 40 is returned to the horizontal state. At this time, the linerless label R is wound back to be tensioned so that the linerless label R between the drive roller DR and the platen roller 45 is horizontal.

The label printer 1 is then pushed back and returned into the housing. The cutting mechanism 50, which has been retracted to a side, is then returned to the front of the print unit 4. An unwind key is then operated to unwind the linerless label R. This unwinding ends when the unwound linerless label reaches a predetermined length. The linerless label is cut by the cutting mechanism 50. The leading edge of the next linerless label is then conveyed backward by a predetermined length and the label printer 1 enters a standby state. Thus, loading of the linerless label R is completed. At this time, the linerless label R is in a state of being pressed by the assist roller AR against the drive roller DR. The linerless label R wound a little in this state is tensioned by the turn roller TR.

When an operator or the like operates to make an instruction to issue a label, the motor M is driven to rotate the drive roller DR and the platen roller 45 at the same time, whereby a predetermined item is printed on the linerless label R. The linerless label R on which the printing has been performed is cut at a location by the cutting mechanism 50 and thereafter fed over the standby rollers 51 of the issuing unit 5. The next linerless label R following the cut linerless label R is fed back until its print start position comes over the platen roller 45.

On the other hand, an adhesive oozing from the edges E of the linerless label R is sent without sticking to the assist roller AR. Non-stick coating is applied to areas with which the linerless label R comes into contact, such as the turn roller TR, the bottom surface of the sensor unit 7, the label guide unit (not illustrated) provided upstream of the cutting mechanism 50, the label holder configured to hold the back end of the linerless label R when the cutting mechanism 50 operates, and the standby rollers 51 configured to hold a cut label. This prevents an adhesive from sticking to the label printer 1.

In the label printer 1 in the foregoing embodiment, the assist roller AR is provided with the contact portion 30 configured to sandwich the linerless label R with the drive roller DR while avoiding an adhesive oozing from the edges of the linerless label R. Consequently, the adhesive oozing from the edges is sent downstream while remaining oozing from the edges of the linerless label R, without sticking to the assist roller AR.

The linerless label R is sandwiched between the drive roller DR and the assist roller AR and fed by rotations of the drive roller DR. The drive roller DR configured to rotate in a state of contacting the adhesive side of the linerless label R is formed of material having excellent release characteristics, such as silicone rubber, for example. In contrast, the assist roller AR configured to rotate in a state of contacting the print side of the linerless label R includes a roller made of resin, for example. Hence, an adhesive oozing from the edges of the linerless label R sticks to the assist roller AR but not the drive roller DR.

For this reason, in the label printer 1 in the foregoing embodiment, the assist roller AR is provided with the contact portion 30 configured to press the linerless label R against the drive roller DR while avoiding an adhesive oozing from the edges of the linerless label. Specifically, the grooves (small-diameter portions) 31 along the circumferential direction are provided to the outer periphery of the assist roller AR at positions that correspond to the edges of the linerless label R along the conveyance direction of the linerless label R, so that an adhesive oozing from the edges does not come into contact with the assist roller AR. Thus, an adhesive oozing from the edges is sent downstream while remaining oozing from the edges of the linerless label R, without sticking to the assist roller AR.

Instead of providing the grooves along the circumferential direction, edge portions of the assist roller AR in the axial direction may be disposed more inward (the side of the print side) than the edges of the linerless label R. Also in this case, an oozing adhesive does not come into contact with the assist roller AR. Consequently, the same effect as in the case where the grooves 31 are provided along the circumferential direction is exerted. However, when the end portions of the assist roller AR are moved closer to the edges of the linerless label R, the width (length in a direction orthogonal to the conveyance direction) of the linerless label R change, and accordingly, the end portions of the assist roller AR needs to be moved in the width direction or the assist roller AR needs to be replaced with another assist roller having a different length.

In contrast, in a case where the grooves 31 are provided, if the assist roller AR is provided with the grooves 31 that correspond with the size of the linerless label R in the axial direction, the assist roller AR can correspond with linerless labels R having different widths, without being moved or replaced. For example, the linerless label R with a large width should be disposed such that its edges align with the outer grooves 31. The linerless label R with a small width should be disposed such that its edges align with the inner grooves 31.

The configuration of the grooves 31 provided to the assist roller AR varies depending on whether the linerless label R is positioned at the center of the assist roller AR or positioned to be aligned with one side of the assist roller AR. That is, if the linerless label R is positioned at the center of the assist roller AR, the grooves 31 are provided to both sides of the assist roller AR so as to be symmetry with respect to a plane. If, on the other hand, the linerless label R is positioned to be aligned with one side of the assist roller AR, one groove 31 is provided to the vicinity of the end portion of the assist roller AR on the side to which the linerless label R is aligned with. Alternatively, instead of the groove 31, the end portion itself of the assist roller AR may face the edge of the linerless label R.

The distance from an edge of the groove 31 to an edge of the linerless label R, or the distance from an end portion of the assist roller AR to an edge of the linerless label R if the end portion of the assist roller AR faces the edge of the linerless label R is preferably approximately 2 to 3 mm. This is because, in a case where the assist roller AR is made of hard material as compared with the drive roller DR made of, for example, silicone rubber, which is soft, if the length of the contact portion 30 of the assist roller AR is much shorter than the width of the linerless label R, both ends of the linerless label R along the conveyance direction of the linerless label R may rise from the contact portion 30 when the linerless label R is pressed against the drive roller DR (when the linerless label R is sandwiched between the drive roller DR and the assist roller AR), thereby causing creases or streaks in the linerless label R. The assist roller AR comes into contact with the linerless label R with a comparatively small width via the contact portion 30, and presses the linerless label R with the small width against the drive roller DR. Furthermore, the assist roller AR comes into contact with the linerless label R with a comparatively large width via the large-diameter ring portions **30*a* and the contact portion 30, and presses the linerless label R with the large width against the drive roller DR. That is, broadening the contact areas of the large-diameter ring portions 30*a*** and the linerless label R can reduce the occurrence of creases or streaks in the linerless label R. Such a trouble, however, relates to the strength with which the assist roller AR presses the linerless label R against the drive roller DR and the extent to which the drive roller DR bends. Consequently, the distance is not absolute. That is, the distance from the end portion of the assist roller AR to the edge of the linerless label R should be appropriately adjusted depending on the properties described above.

In contrast, the drive roller DR is configured to come into contact with the linerless label R across the full width of the linerless label R in a direction orthogonal to the conveyance direction of the linerless label R. With this configuration, the drive roller DR comes into contact with the adhesive side of the linerless label R across the full width to uniformly pull the linerless label R. Hence, the fed linerless label R does not snake.

The oozing of the adhesive from the edges of the linerless label R mainly results from process of manufacturing the label roll RR. There is a case in which an adhesive oozes from one roll end face of the label roll RR and a case in which an adhesive oozes from both roll end faces of the label roll RR. This depends on label makers. If the side to which an adhesive to ooze has been identified, the groove 31 should be provided to the assist roller AR at a position corresponding to an edge of the linerless label R on the side to which an adhesive is to ooze.

In the label printer 1 in the foregoing embodiment, the linerless label R unwound from the label roll RR is conveyed to the print unit 4 while holding an adhesive oozing from the edge, in order to be printed, and further conveyed downstream to the issuing unit 5 to be cut to a predetermined length and issued as a label for a commodity.

The edge of the linerless label R fed in such a manner has a oozing adhesive stuck thereon. For this reason, in the label printer 1 according to the foregoing embodiment, non-stick coating is applied on a conveyance path, along which the linerless label R is fed, especially to the areas with which the oozing adhesive comes into contact. Specifically, the non-stick coating is applied to the areas with which the linerless label R comes into contact, in the conveyance path of the linerless label R. The areas are of the turn roller TR disposed between the label roll RR and the drive roller DR, the sensor unit 7 disposed between the drive roller DR and the print unit 4, and the issuing unit 5 configured to issue labels for commodities after the linerless label R pass the print unit 4.

The issuing unit 5 includes, for example, the label guide unit (not illustrated) configured to feed the printed linerless label R to the cutting mechanism 50, the cutting mechanism 50 configured to cut the linerless label R to a predetermined length, the label holder configured to hold the linerless label R at the vicinity of a boundary to be cut at the time of cutting the linerless label R, and the standby rollers 51 configured to hold a cut label for a commodity. Non-stick coating is applied to some areas of these components, areas with which the linerless label R and labels for commodities come into contact.

With this configuration, an adhesive oozing from the edges of the linerless label R does not stick to the components constituting the label printer 1 until the linerless label R is stuck on a commodity as a label for the commodity. This can reduce conventionally required work of removing an adhesive.

In the foregoing, one embodiment of an aspect of the present disclosure has been described. However, an aspect of the present disclosure is not limited to the embodiment, but can employ other configurations. For example, an aspect of the present disclosure can employ the configuration in which the assist roller AR is attached to the support shaft 33 in a slidable manner in the axial direction and a positioning unit is provided so that such positioning is performed that the grooves 31 provided in the assist roller AR overlap the edges of the linerless label and the end portions of the assist roller AR approach the edges of the linerless label.

Figure 8B:
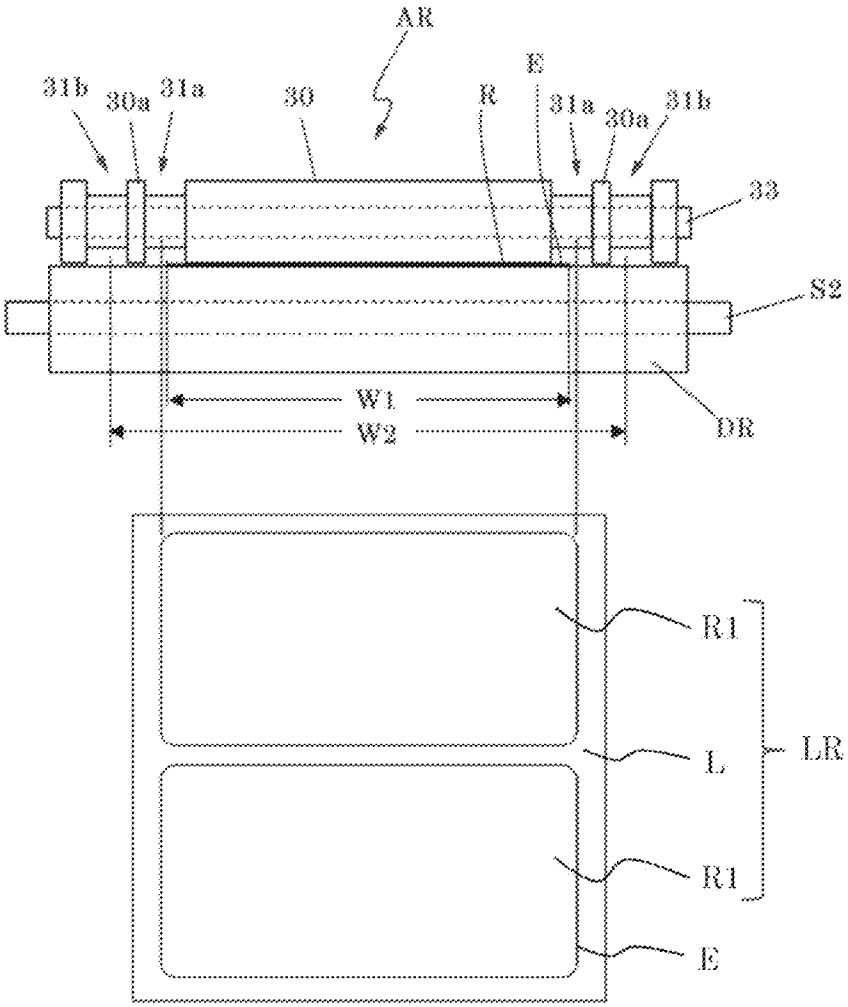
FIG. 8B is a relationship diagram of the drive roller and the assist roller in the case of conveying a label with liner.
Figure 8A:
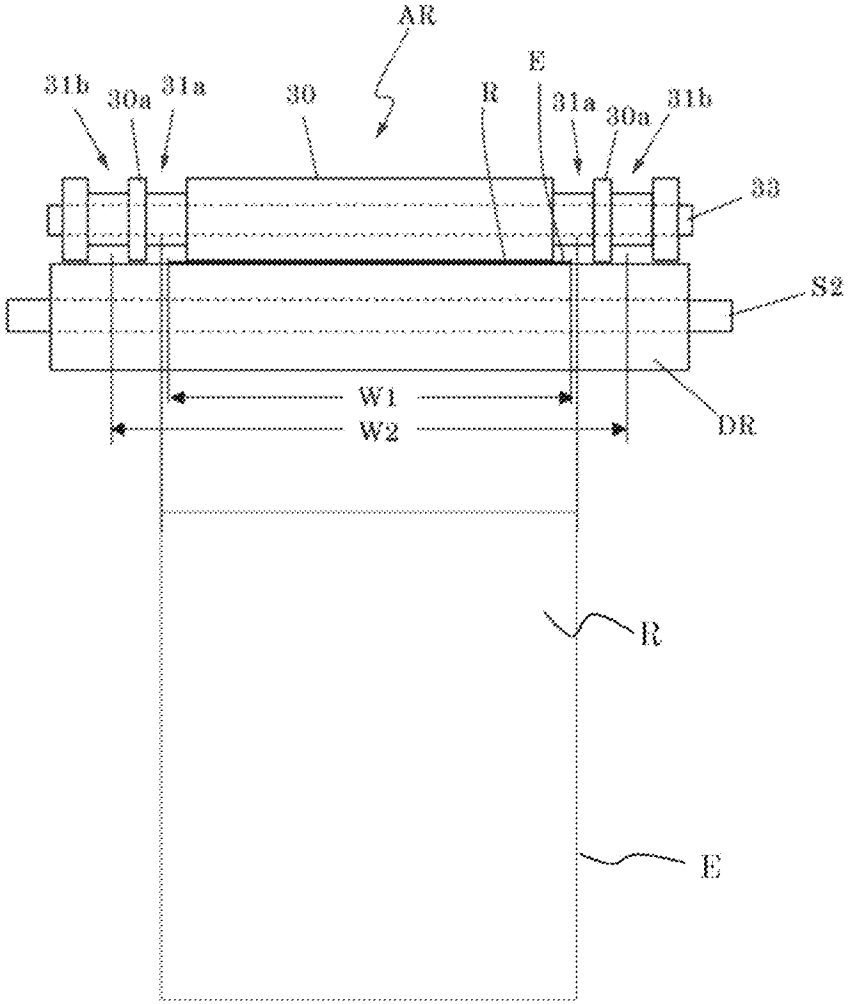
FIG. 8A is a relationship diagram of a drive roller and an assist roller in the case of conveying the linerless label.
Figure 9:
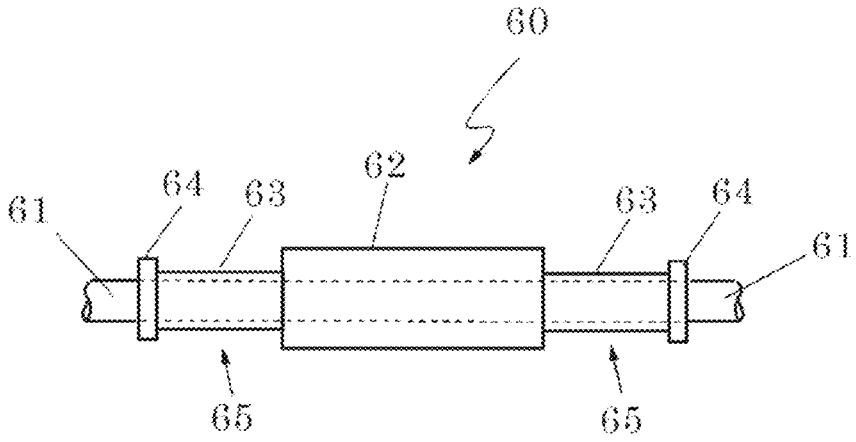
FIG. 9 is an explanatory drawing of an assist roller disclosed in Japanese Unexamined Patent Publication No. 2009-78839.

The label printer 1 in the foregoing embodiment has been described with an example of conveying the linerless label R as illustrated in FIG. 8A. However, labels with liner LR the adhesive sides of which are stuck on a liner (release liner) L, as illustrated in FIG. 8B, may be conveyed. This liner L may be longer than a label R1 in the width direction. "At least one of the edges of the label along the conveyance direction of the label" in this case also means an end of the label R1 but not an end of the liner L. Moreover, in the width direction, the length of the liner L may be equal to the length of the label R1. Furthermore, in the label printer configured to issue the labels with liner LR, the issuing unit 5 includes a release unit configured to release labels R1 from the liner L to perform issuing, instead of the cutting mechanism 50 (or in addition to the cutting mechanism 50).

The label printer 1 in the foregoing embodiment has been described with an example in which the contact portion 30 is provided so as to avoid coming into contact with an adhesive oozing from at least one of the edges of the linerless label R along the conveyance direction of the linerless label R. However, the contact portion 30 may be provided so as to avoid coming into contact with an adhesive oozing from at least one of the edges of the linerless label R along the conveyance direction of the linerless label R by being sandwiched between the assist roller AR and the drive roller DR.

What is claimed is:

1. A conveyance mechanism for conveying a label including an adhesive side on which an adhesive has been provided, the conveyance mechanism comprising:

a drive roller; and a rotatably provided assist roller; wherein the drive roller and the assist roller are configured to sandwich the label, and the drive roller is driven in order to unwind the label from a label roll on which the label is wound, an outer surface of the assist roller includes a contact portion configured to come into contact with at least a part of the print side of the label, the contact portion is provided so as to avoid coming into contact with a portion of the adhesive oozing from at least one of edges of the label along a conveyance direction of the label, the assist roller includes a plurality of small diameter portions, each with an outer diameter smaller than an outer diameter of the contact portion, and the plurality of small diameter portions is provided in a lengthwise direction of the rotation shaft of the assist roller in a region into which the portion of the adhesive oozes from one of the edges of the label, and their positions in the width direction correspond to a plurality of labels each having a different width.

2. The conveyance mechanism according to claim 1, wherein an outer surface of the drive roller has release characteristics with respect to the label that are superior to release characteristics of the outer surface of the assist roller with respect to the label.

3. The conveyance mechanism according to claim 1, wherein the drive roller comes into contact with the label across a full width in a direction orthogonal to the conveyance direction of the label.

4. The conveyance mechanism according to claim 1, wherein one of the small diameter portions is provided in the lengthwise direction in a region having a predetermined width centered on one of the edges.

5. The conveyance mechanism according to claim 1, wherein the label is a label with liner the adhesive side of which is stuck on a liner.

6. The conveyance mechanism according to claim 1, the label may be a linerless label the adhesive side of which is exposed.

7. A label printer comprising:

a loading unit into which a label roll is to be loaded;

the conveyance mechanism according to claim 5 configured to unwind the label with liner from the loading unit;

a print unit configured to perform printing on the label with liner fed from the conveyance mechanism; and an issuing unit disposed downstream of the print unit in the conveyance direction and configured to issue the printed label with liner.

8. A label printer comprising:

a loading unit into which a label roll is to be loaded;

the conveyance mechanism according to claim 6 configured to unwind the linerless label from the loading unit;

a print unit configured to perform printing on the linerless label fed from the conveyance mechanism; and an issuing unit disposed downstream of the print unit in the conveyance direction and configured to issue the printed linerless label.

9. The label printer according to claim 8, wherein a non-stick coating is applied to areas with which the adhesive side of the linerless label comes into contact in the conveyance path of the linerless label.

* * * * *